US012674373B2

(12) United States Patent
McChesney et al.

(10) Patent No.: US 12,674,373 B2
(45) Date of Patent: Jul. 7, 2026

(54) FLUIDIC MANIFOLD FOR OPENING AND CLOSING A DOWNHOLE VALVE

(71) Applicant: Halliburton Energy Services, Inc., Houston, TX (US)

(72) Inventors: Ryan W. McChesney, Prosper, TX (US); Gordon McLeary, Frisco, TX (US); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/187,581

(22) Filed: Apr. 23, 2025

(65) Prior Publication Data

US 2025/0334023 A1 Oct. 30, 2025

Related U.S. Application Data

(60) Provisional application No. 63/638,024, filed on Apr. 24, 2024.

(51) Int. Cl.
*E21B 34/06* (2006.01)
*E21B 41/00* (2006.01)

(52) U.S. Cl.
CPC ..... *E21B 34/066* (2013.01); *E21B 41/0085* (2013.01)

(58) Field of Classification Search
CPC ..... E21B 34/066; E21B 41/0085
USPC ..... 166/373
See application file for complete search history.

(56) References Cited

U.S. PATENT DOCUMENTS

| | | | | |
|---|---|---|---|---|
| 7,409,999 | B2 * | 8/2008 | Henriksen | E21B 34/10 166/330 |
| 10,428,619 | B2 | 10/2019 | Poluchalla et al. | |
| 10,724,334 | B2 | 7/2020 | Poluchalla et al. | |
| 11,008,831 | B2 | 5/2021 | Minassa et al. | |
| 11,105,183 | B2 | 8/2021 | Frosell et al. | |

(Continued)

OTHER PUBLICATIONS

Halliburton. "EquiFlow Autonomous Inflow Control Devices (AICDs)." Halliburton Data Sheet, 2024. H08364 Nov. 2024. PDF file. 3 pages.

(Continued)

*Primary Examiner* — Tara Schimpf
*Assistant Examiner* — Patrick F Lambe
(74) *Attorney, Agent, or Firm* — Scott Richardson; C. Tumey Law Group PLLC

(57) ABSTRACT

A system may include a production valve secured in a production fluid line of a downhole tubular. The production valve is configured to control flow through the production fluid line between a wellbore annulus and a central bore of the downhole tubular. The system may further include a pilot line extending at least to the production valve from the annulus. A flow restrictor disposed within the pilot line is configured to increase fluid pressure in the pilot line. Further, the system may include a solenoid valve secured within the pilot line and configured to actuate between an open state and a closed state in response to instructions from a controller. Pressure in the pilot line is configured to rise above an actuation threshold pressure configured to close the production valve in response to formation fluid flowing through the solenoid valve in the open state of the solenoid valve.

20 Claims, 7 Drawing Sheets

(56) References Cited

U.S. PATENT DOCUMENTS

| | | | | |
|---|---|---|---|---|
| 11,187,060 | B2 | 11/2021 | Minassa et al. | |
| 11,274,526 | B2 | 3/2022 | Deville et al. | |
| 11,434,722 | B2 | 9/2022 | Green et al. | |
| 12,241,346 | B1 | 3/2025 | Greci et al. | |
| 2011/0146987 | A1* | 6/2011 | Williamson | C09K 8/00 166/293 |
| 2012/0267119 | A1* | 10/2012 | Patel | E21B 34/10 166/373 |
| 2013/0048299 | A1 | 2/2013 | Fripp et al. | |
| 2014/0131029 | A1* | 5/2014 | Harms | E21B 47/06 166/66.4 |
| 2017/0254174 | A1 | 9/2017 | Least et al. | |
| 2018/0171759 | A1 | 6/2018 | Meyer et al. | |
| 2019/0195047 | A1 | 6/2019 | Rong et al. | |
| 2020/0063518 | A1 | 2/2020 | Fripp et al. | |
| 2020/0291745 | A1 | 9/2020 | Greci et al. | |
| 2020/0308927 | A1 | 10/2020 | Fripp et al. | |
| 2020/0362667 | A1 | 11/2020 | Zachariah et al. | |
| 2021/0062615 | A1 | 3/2021 | Fripp et al. | |
| 2021/0198975 | A1 | 7/2021 | Honeker et al. | |
| 2021/0254440 | A1 | 8/2021 | Zachariah et al. | |
| 2022/0018228 | A1 | 1/2022 | McChesney et al. | |
| 2022/0195821 | A1 | 6/2022 | McChesney et al. | |
| 2022/0195837 | A1 | 6/2022 | McChesney et al. | |
| 2022/0195850 | A1 | 6/2022 | El Mallawany et al. | |
| 2022/0397021 | A1 | 12/2022 | El Mallawany et al. | |
| 2024/0076968 | A1 | 3/2024 | Greci et al. | |
| 2024/0401444 | A1 | 12/2024 | McChesney et al. | |
| 2024/0410257 | A1 | 12/2024 | McChesney et al. | |
| 2025/0067154 | A1 | 2/2025 | Greci et al. | |
| 2025/0075598 | A1 | 3/2025 | El Mallawany et al. | |
| 2025/0075599 | A1 | 3/2025 | El Mallawany et al. | |
| 2025/0084730 | A1 | 3/2025 | Fripp et al. | |
| 2025/0092765 | A1 | 3/2025 | McChesney et al. | |
| 2025/0092771 | A1 | 3/2025 | Greci et al. | |
| 2025/0188814 | A1 | 6/2025 | McChesney et al. | |
| 2025/0188815 | A1 | 6/2025 | McChesney et al. | |
| 2025/0206539 | A1 | 6/2025 | McChesney et al. | |

OTHER PUBLICATIONS

Halliburton. "EquiFlow Adjustable Nozzle Inflow Control Device." Halliburton Data Sheet, 2024. H010897 Nov. 2024. PDF file. 2 pages.

Provisional U.S. Appl. No. 63/757,163, filed Feb. 11, 2025.

International Search Report and Written Opinion for International Patent Application No. PCT/US2025/026175 dated Aug. 8, 2025. PDF file. 10 pages.

* cited by examiner

FLUIDIC MANIFOLD FOR OPENING AND CLOSING A DOWNHOLE VALVE

CROSS-REFERENCE TO RELATED APPLICATIONS

The present application is a non-provisional conversion of U.S. Provisional Patent Application No. 63/638,024, which was filed on Apr. 24, 2024, the entire disclosure of which is incorporated herein by reference.

BACKGROUND

During completion operations for a hydrocarbon production well, it is generally beneficial to regulate flow of formation fluids from an earth formation into production tubing and/or flow between other downhole tools and features. Such regulation of flow may serve a variety of purposes such as prevention of water or gas coning, minimizing sand production, minimizing water and/or gas production, maximizing oil production, balancing production among zones, transmitting signals, etc. Downhole valves are generally used to regulate downhole fluid flow. Such downhole valves may be controlled via electric motors driving a valve feature (e.g., lead screw). However, electric motors used in downhole operations are generally small and require substantial gear reduction to produce adequate torque, making the actuation time slow (e.g., up to an hour). Alternatively, downhole valves may be controlled via hydraulic systems, which provide faster actuation times. Unfortunately, a hydraulic system generally requires a pump or reservoir charged with fluid pressure, which introduces additional complexity for a downhole system.

BRIEF DESCRIPTION OF THE DRAWINGS

These drawings illustrate certain aspects of some of the embodiments of the present disclosure and should not be used to limit or define the system or method.

DETAILED DESCRIPTION

Disclosed herein are systems and methods for operating a production valve and, more particularly, example embodiments may include a production valve actuated via a fluidic manifold. For example, the fluidic manifold may include a solenoid valve and flow resistor disposed within a pilot line in fluid communication with a production valve, which may provide the benefits of a hydraulically actuated valve (e.g., quick actuation) without requiring a pump or reservoir charged with fluid pressure. As set forth in greater detail below, the solenoid valve may control flow into the pilot line. The solenoid valve may open relatively quickly due to the size of the pilot line with respect to a main flow path to the production valve. Moreover, the flow resistor may operate to increase pressure in the pilot line, such that sufficient pressure may be provided to hydraulically close the production valve in response to the solenoid valve opening. Accordingly, the fluidic manifold may be configured to quickly actuate without the additional complexity of requiring a pump or reservoir charged with fluid pressure.

Figure 1:
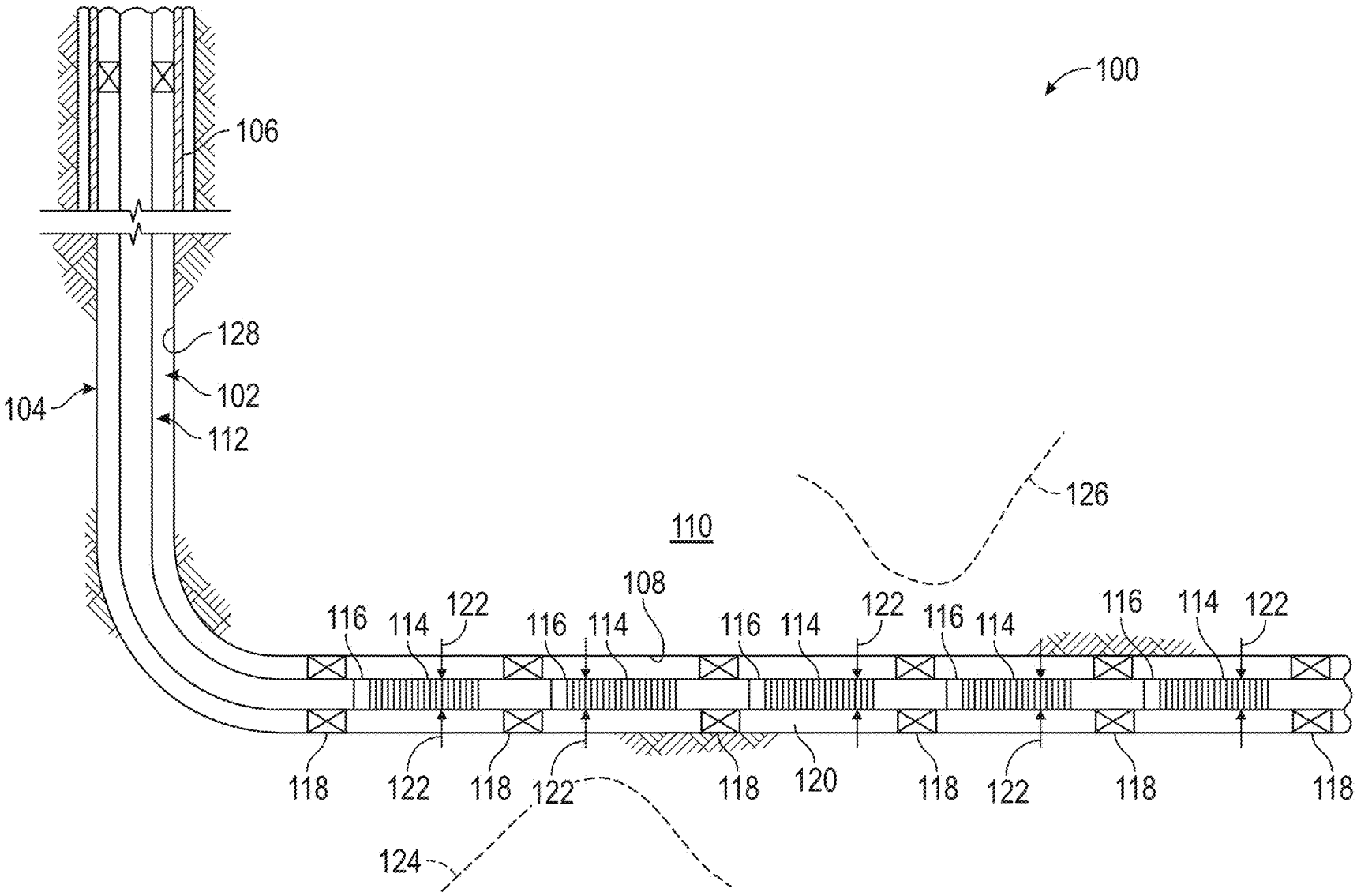
FIG. 1 illustrates an elevation view of a downhole system, in accordance with one or more embodiments of the present disclosure.

FIG. 1 illustrates a schematic view of a downhole system 100, in accordance with one or more embodiments of the present disclosure. As illustrated, a borehole (e.g., wellbore 102) may include a generally vertical wellbore section 104 extending downwardly from casing 106, as well as a generally horizontal wellbore section 108 extending through an earth formation 110. A downhole tubular 112 (e.g., production tubing string) is installed in the wellbore 102. The downhole tubular 112 may include multiple well screens 114, production valves 116, and packers 118. As illustrated, the packers 118 are configured to seal off portions of an annulus 120 formed radially between the downhole tubular 112 and a wellbore wall 128 of the wellbore 102. In particular, the packers 118 are configured to isolate multiple intervals or production zones from each other. Each interval or production zone may be formed between an adjacent pair of packers 118.

Formation fluid may be produced from the multiple intervals or zones of the formation 110 isolated by the packers 118. Moreover, the tubing string extending through each interval or production zone may include at least one well screen 114 and at least one production valve 116, which may be interconnected. The well screen 114 may be configured to filter the formation fluid 122 flowing into the downhole tubular 112 from the annulus 120. As set forth in greater detail below, the at least one production valve 116 may restrict flow of the formation fluid 122 into the downhole tubular 112. The at least one production valve 116 may include any suitable production valve. For example, the at least one production valve 116 may include a diaphragm type valve, a bellows type valve, a pilot operated valve, a piston valve, or some combination thereof. Further, the at least one production valve 116 may include an inflow control valve (e.g., a density autonomous inflow control device).

At this point, it should be noted that the downhole system 100 is illustrated in the drawings and is described herein as merely one example of a wide variety of downhole systems in which the principles of this disclosure can be utilized. It should be clearly understood that the principles of this disclosure are not limited at all to any of the details of the downhole system 100, or components thereof, depicted in the drawings or described herein.

For example, it is not necessary in keeping with the principles of this disclosure for the wellbore 102 to include the generally vertical wellbore section 104 or the generally horizontal wellbore section 108, as a wellbore section may be oriented in any direction, and may be cased or uncased, without departing from the scope of the present disclosure. It is not necessary for formation fluid 122 to be only produced from the formation 110 as, in other examples, fluids could be injected into a formation, such as injected through the downhole tubular 112 and out into the formation 110, or fluids could be both injected into and produced from a formation, etc. Further, it is not necessary for one of each of the well screens 114 and the production valves 116 to be positioned between each adjacent pair of the packers 118. It is not necessary for a single production valve 116 to be used in conjunction with a single well screen 114. A ny number, arrangement and/or combination of these components may be used.

It is not necessary for the at least one production valve 116 to be used with a well screen 114. For example, in injection operations, the injected fluid could be flowed through the at least one production valve 116, without also flowing through a well screen 114.

It is not necessary for the well screens 114, the at least one production valve 116, the packers 118 or any other components of the downhole tubular 112 to be positioned in uncased sections of the wellbore 102. Any section of the wellbore 102 may be cased or uncased, and any portion of the downhole tubular 112 may be positioned in an uncased or cased section of the wellbore, in keeping with the principles of this disclosure.

It should be clearly understood, therefore, that this disclosure describes how to make and use certain examples, but the principles of the disclosure are not limited to any details of those examples. Instead, those principles can be applied to a variety of other examples using the knowledge obtained from this disclosure.

It will be appreciated by those skilled in the art that it would be beneficial to be able to regulate flow of the formation fluid 122 into the downhole tubular 112 from each zone of the formation 110, for example, to prevent water coning 124 or gas coning 126 in the formation 110. Other uses for flow regulation in a well include, but are not limited to, balancing production from (or injection into) multiple zones, minimizing production or injection of undesired fluids, maximizing production or injection of desired fluids, etc.

As set forth in greater detail below, the system may be configured to operate the at least one production valve 116 to provide these benefits by increasing resistance to flow if a fluid velocity increases beyond a selected level (e.g., to thereby balance flow among zones, prevent water coning 124 or gas coning 126, etc.), or increasing resistance to flow if a fluid viscosity decreases below a selected level (e.g., to thereby restrict flow of an undesired fluid, such as water or gas, in an oil producing well).

Whether a formation fluid 122 is a desired or an undesired fluid depends on the purpose of the production or injection operation being conducted. For example, if it is desired to produce oil from a well, but not to produce water or gas, then oil is a desired fluid and water and gas are undesired fluids.

Note that, at downhole temperatures and pressures, hydrocarbon gas can actually be completely or partially in liquid phase. Thus, it should be understood that when the term "gas" is used herein, supercritical, liquid and/or gaseous phases are included within the scope of that term.

Figure 2:
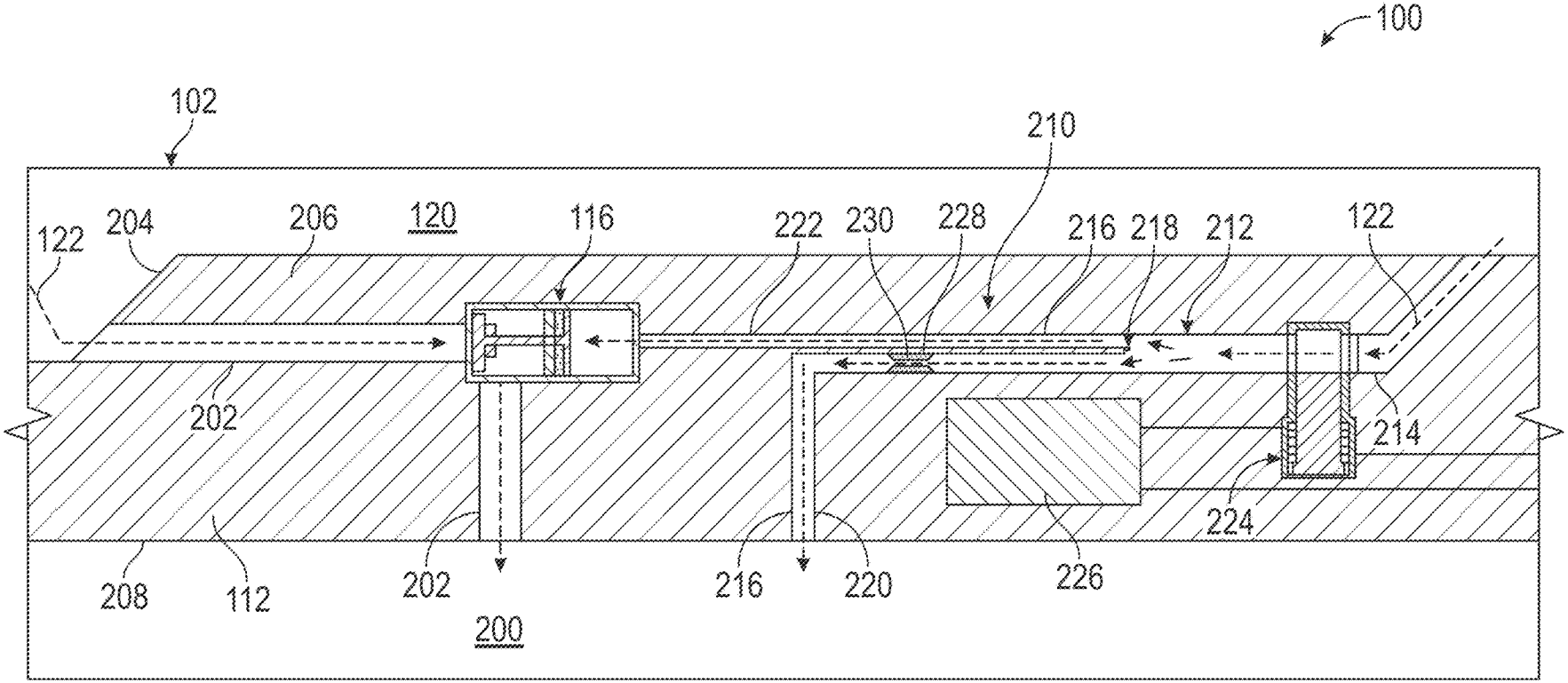
FIG. 2 illustrates a cross-sectional view of a fluidic manifold configured to open and close a downhole production valve, in accordance with one or more embodiments of the present disclosure.

FIG. 2 illustrates a cross-sectional view of a fluidic manifold configured to open and close a downhole production valve, in accordance with one or more embodiments of the present disclosure. A s set forth above, the downhole system 100 may include a downhole tubular 112 (e.g., a production tubing string) disposed within the wellbore 102. Further, at least one production valve 116 may be secured to the downhole tubular 112 to control flow of formation fluid 122 into a central bore 200 of the downhole tubular 112 from the annulus 120 of the wellbore 102. As illustrated, a production fluid line 202 may extend from an outer surface 204 of a body portion 206 of the downhole tubular 112 to an inner surface 208 of the body portion 206. During production operations, the formation fluid may flow from the annulus 120 to the central bore 200 via the production fluid line 202. Moreover, as illustrated, the at least one production valve 116 may be disposed along the production fluid line 202 to control the flow of the formation fluid 122 through the production fluid line 202. In particular, the at least one production valve 116 may be configured to actuate between various positions (e.g., open, partially open, closed, etc.) to control the flow of the formation fluid. Further, as set forth in greater detail below, a fluidic manifold 210 may be configured to actuate the at least one production valve 116 between the various positions.

The fluidic manifold 210 may include a pilot line 212 configured to provide hydraulic pressure to the at least one production valve 116 for actuating the at least one production valve 116 between the various positions. As illustrated, the pilot line 212 may include a main pilot line 214 (e.g., main pilot line portion) extending from the outer surface 204 of the body portion 206 to a junction 218 (e.g., pilot line junction) positioned within the body portion 206 of the downhole tubular 112. The main pilot line 214 may be configured to separate into a plurality of pilot line branches 216 at a junction 218. For example, as illustrated, the pilot line 212 may include a first pilot line branch 220 extending from the junction 218 to the central bore 200 of the downhole tubular 112 and a second pilot line branch 222 extending from the junction 218 to the at least one production valve 116.

The fluidic manifold 210 may further include a solenoid valve 224 disposed along the main pilot line 214. The solenoid valve 224 may include any suitable type of solenoid valve 224 (e.g., pilot-operated solenoid valve, direct-acting solenoid valve, etc.) As set forth in greater detail below, the solenoid valve 224 may be in electronic communication with a system controller 226 that is configured to output instructions to the solenoid valve 224 in response to detected conditions of the formation fluid passing through the at least one production valve 116 and into the central bore 200. The solenoid valve 224 may be configured to actuate between an open state and a closed state in response to instructions from the system controller 226. Additionally, the solenoid valve 224 may be configured to actuate to at least one partially open state. For example, the solenoid valve 224 may be configured to actuate between a closed state, a 33% open state, a 66% open state, and an open state. Indeed, the solenoid valve 224 may be configured to actuate between any suitable combination of states.

As set forth above, the solenoid valve 224 is disposed along the main pilot line 214. As such, in the open state of the solenoid valve 224, the formation fluid may flow unhindered through the main pilot line 214 from the annulus 120 to the junction 218 and continue to flow into both the first pilot line branch 220 and the second pilot line branch 222 via the junction 218. The second pilot line branch 222 may extend to the at least one production valve 116 such that at least a portion of the formation fluid entering the main pilot line 214 is configured to flow to the at least one production valve 116 with the solenoid valve 224 in the open state.

Moreover, as set forth above, the first pilot line branch 220 may extend from the junction 218 to the central bore 200 of the downhole tubular 112 such that a portion of the formation fluid entering the main pilot line 214 is configured to flow to the central bore 200 with the solenoid valve 224 in the open state. However, as illustrated, a flow restrictor 228 (e.g., a pilot line choke nozzle 230, an elongated section of tubing, etc.) may be disposed along the first pilot line branch 220 to increase the pressure of the formation fluid in the pilot line 212. In particular, the formation fluid flowing through the first pilot line branch 220 is configured to pass through the flow restrictor 228 as it flows toward to the central bore 200 of the downhole tubular 112. The flow restrictor 228 is configured to add flow resistance to the fluid passing through the flow restrictor 228 such that the pressure in the pilot line 212 (i.e., between the solenoid valve 224, the at least one production valve 116, and the flow restrictor 228) may increase. The amount of pressure in the pilot line 212 may be based at least in part on the flow rate of formation fluid through the solenoid valve 224, as well as the effectiveness of the flow restrictor 228. As such, actuating the solenoid valve 224 between various states (e.g., open, partially open, closed, etc.) may control the pressure in the pilot line 212.

Moreover, as set forth above, the at least one production valve 116 may be disposed in the production fluid line 202 extending from the annulus 120 to the central bore 200 of the downhole tubular 112 to control the flow of the formation fluid 122 into the central bore 200 of the downhole tubular 112, via the production fluid line 202. Further, the production fluid line 202 includes an upper production line portion extending from the annulus 120 to the at least one production valve 116, wherein the upper production line portion includes a larger diameter than the pilot line 212. Moreover, the at least one production valve 116 may be configured to control the flow of the formation fluid 122 based on a state (e.g., open, partially open, closed, etc.) of the production valve 116. The state of the at least one production valve 116 may be based at least in part on the pressure in the pilot line 212. That is, the at least one production valve 116 may be configured to actuate between the various states (e.g., open, partially open, closed, etc.) based on the pressure in the pilot line 212.

For example, solenoid valve 224 may be configured to open to raise the pressure in the pilot line 212 above an actuation threshold pressure (e.g., an upper actuation threshold pressure. The at least one production valve 116 may be configured to actuate from the open state to the closed state in response to a pressure in the pilot line 212 rising above the actuation threshold pressure. Similarly, the at least one production valve 116 may be configured to actuate from the closed state to the open state in response to a pressure in the pilot line 212 falling below a lower actuation threshold pressure. Moreover, the at least one production valve 116 may be configured to actuate to a partially open state in response to a pressure in the pilot line 212 being within a partial activation pressure range. A lower bound of the partial activation pressure range may be the lower actuation threshold pressure, and an upper bound of the partial activation pressure range may be the upper actuation threshold pressure. However, the production valve 116 may be configured to actuate between the open state, the closed state, and/or the partially open state in response to any suitable pressure thresholds or ranges.

Further, the system controller 226 may be configured to output instructions to the solenoid valve 224 to control the pressure in the pilot line 212 in response to detected conditions of the formation fluid passing through the at least one production valve 116 and into the central bore 200. For example, the system controller 226 may determine that the formation fluid 122 entering into the downhole tubular 112, via the production valve 116, has a high percentage of water. As such, it may be desirable to restrict or reduce flow of the formation fluid 122 into the downhole tubular 112 via the at least one production valve 116. Accordingly, the system controller 226 may output a signal to the solenoid valve 224 to open. Opening the solenoid valve 224 may result in an increased pressure in the pilot line 212, which may be configured to close the production valve 116. Moreover, the production valve 116 may be configured to remain in a closed state in response to pressure from the pilot line 212 holding the production valve 116 closed. Thus, the production valve 116 may be configured to open in response to the pressure reduction in the pilot line 212 from the solenoid valve 224 closing. Further, with the production valve 116 closed, formation fluid into the central bore 200, via the production fluid line 202 and the pilot line 212, may be restricted, which should reduce the flow rate of the formation fluid 122 having a high percentage of water entering the central bore 200 of the downhole tubular 112.

Alternatively, the at least one production valve 116 may be configured to open in response to a pressure increase in the pilot line 212 from the solenoid valve 224 opening. For example, the controller may determine that the formation fluid 122 entering into the downhole tubular 112, via the production valve 116, has a high percentage of oil. As such, the system controller 226 may output a signal to the solenoid valve 224 to open, which may increase the pressure in the pilot line 212 and open the at least one production valve 116. With the at least one production valve 116 opened, formation fluid 122 flowing into the central bore 200, via the production fluid line 202, may be less restricted, which should increase the flow rate of the formation fluid having a high percentage of oil entering the central bore 200 of the downhole tubular 112.

Figure 3:
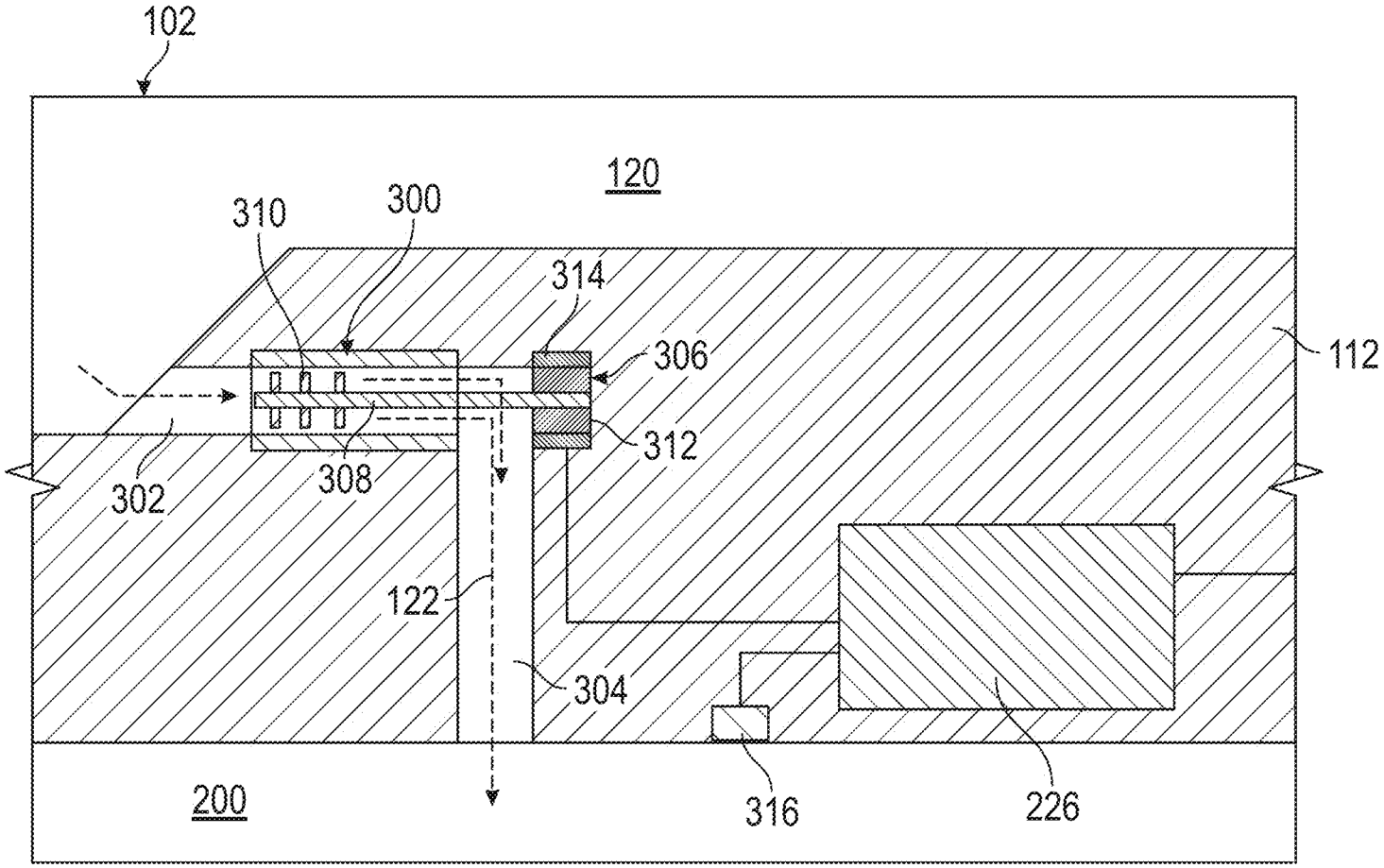
FIG. 3 illustrates a cross-sectional view of a power generation assembly configured to provide power to a controller configured to actuate a solenoid valve of the fluidic manifold, in accordance with one or more embodiments of the present disclosure.

FIG. 3 illustrates a cross-sectional view of a power generation system configured to provide power to a controller configured to actuate a solenoid valve of the fluidic manifold, in accordance with one or more embodiments of the present disclosure. As illustrated, a turbine 300 may be secured to the downhole tubular 112. In particular, the turbine 300 may be secured in a position along a flow path 302 (e.g., a power fluid line 304) extending from the annulus 120 of the wellbore 102 to the central bore 200 of the downhole tubular 112. The turbine 300 may be disposed within a turbine chamber formed. The turbine 300 may be disposed in any suitable position along the power fluid line 304 in the body portion 206 of the downhole tubular 112.

A generator 306 may also be secured to the downhole tubular 112 in any suitable position such that the generator 306 may be coupled to the turbine 300. As illustrated, the generator 306 may be coupled to the turbine 300 via a shaft 308 extending between the generator 306 and the turbine 300. The turbine 300 is configured to rotate in response to the formation fluid 122 flowing through the turbine 300 as the formation fluid 122 flows along the flow path 302 (e.g., the power fluid line 304) from the annulus 120 toward the central bore 200 of the downhole tubular 112. For example, the turbine 300 may include turbine blades 310 coupled to the shaft 308. The turbine blades 310 may be configured to rotate the shaft 308 in response to the flow of the formation fluid 122 across the turbine blades 310. The generator 306 is configured to generate power in response to rotation of the shaft 308 driven by the rotation of the turbine 300. For example, the generator 306 may include a rotor 312 secured to the shaft 308 such that rotation of the shaft 308 drives rotation of the rotor 312. The rotor 312 may be configured to rotate with respect to a stator 314 of the generator 306, which may generate power. Further, the power generated by the generator 306 may be output to the system controller 226. The turbine 300 and generator 306 may be configured to generate any suitable amount of power for operating the system controller 226, the solenoid valve, and/or other electronic devices coupled to the system controller.

Moreover, the system controller 226 may be secured within the downhole tubular 112. The system controller 226 may include a printed circuit board, or any other suitable electronic device, for outputting instructions to the solenoid valve 224 (shown in FIG. 2). As set forth above, the system controller 226 may be in electronic communication with the solenoid valve 224. In particular, the system configured is configured to output instructions to the solenoid valve 224 to actuate the solenoid valve 224 between the open state, the closed state, and/or the partially open state in response to determined conditions of the formation fluid 122 passing through the at least one production valve 116 and into the central bore 200.

At least one sensor 316 may be in communication with the system controller 226. The at least one sensor 316 may be configured to measure at least one parameter (e.g., temperature, flow rate, etc.) of the formation fluid 122 flowing into the central bore 200. Further, the at least one sensor 316 may be configured to output sensor data to the system controller 226. The sensor data may include the at least one parameter. The system controller 226 may be configured to receive and analyze the sensor data to determine the condition of the formation fluid 122 passing through the at least one production valve 116 and into the central bore 200. For example, the system controller 226 may be configured to determine a percentage of water in the formation fluid 122 based at least in part on the sensor data received from the at least one sensor. Further, the system controller 226 may be configured to output instructions to the solenoid valve 224 to actuate to the open state in response to determining that the percentage of water in the formation fluid 122 is greater than 60%. Alternatively, the system controller 226 may be configured to output instructions to the solenoid valve 224 to actuate to the open state in response to determining that the percentage of water in the formation fluid 122 is greater than a predetermined threshold (e.g., 70%, 80%, or 90%). The controller may be configured to output instructions to the solenoid valve 224 to actuate to the open state in response to the system controller 226 determining that any parameter (e.g., water percentage, natural gas percentage, etc.) has exceeded any suitable threshold.

Figure 4:
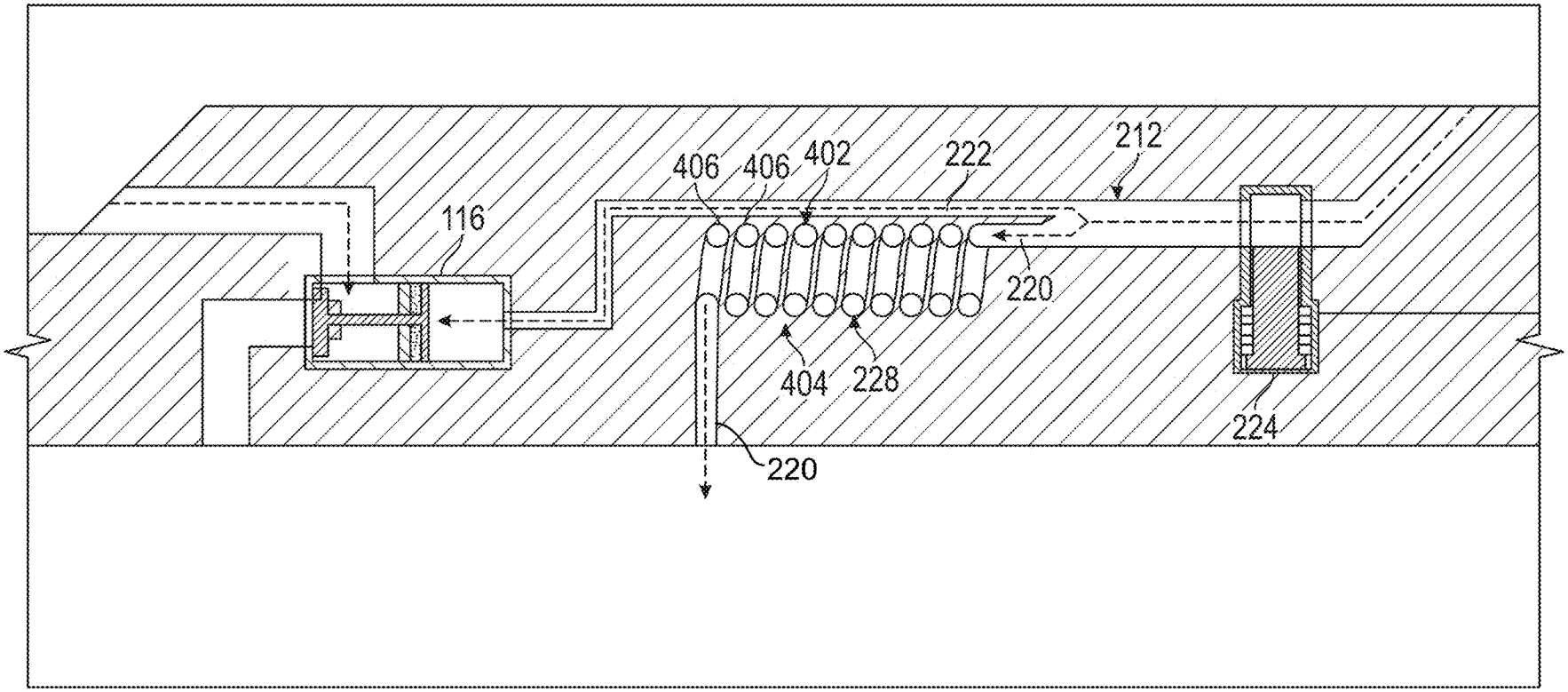
FIG. 4 illustrates a cross-sectional view of a flow restrictor of the fluidic manifold, in accordance with one or more embodiments of the present disclosure.

FIG. 4 illustrates a cross-sectional view of a flow restrictor of the fluidic manifold, in accordance with one or more embodiments of the present disclosure. As set forth above, the flow restrictor 228 may include the pilot line choke nozzle 230 (shown in FIG. 2) disposed within the first pilot line branch 220 to increase the flow resistance in the first pilot line branch 220. Alternatively, or additionally, the flow restrictor 228 may include a tortuous fluid path 400 formed along the first pilot line branch 220. The tortuous fluid path 400 may also be configured to increase flow resistance through at least a portion of the first pilot line branch 220, which may increase fluid pressure in the pilot line 212. In particular, the tortuous fluid path 400 may be configured to increase the fluid pressure in the pilot line 212 between the solenoid valve 224, the flow restrictor 228, and the at least one production valve 116.

The flow restrictor 228 may include any suitable type of tortuous fluid path 400. For example, as illustrated, the tortuous fluid path 400 may include an elongated section 402 of the first pilot line branch 220. The elongated section 402 may be at least twice as long as the second pilot line branch 222. Further, the elongated section 402 of the first pilot line branch 220 may include an elongated length and an inner diameter. The elongated length may be at least fifty times longer than the inner diameter, such that the elongated section 402 may increase flow resistance through the first pilot line branch 220. Alternatively, the elongated length may be at least seventy times longer than the inner diameter. The elongated length may include any suitable length for increasing the flow resistance through the first pilot line branch 220. Moreover, the elongated section 402 of the first pilot line branch 220 may follow a helical path. The helical path of the elongated section 402 may include any suitable number of turns 406. Further, helical path of the elongated section may include any suitable pitch. Additionally, the elongated section 402 may include a variable inner diameter. However, the elongated section 402 may alternatively include a constant inner diameter along the length of the elongated section 402. Indeed, the elongated section 402 may include any suitable features for increasing the flow resistance through the first pilot line branch 220.

Figure 5:
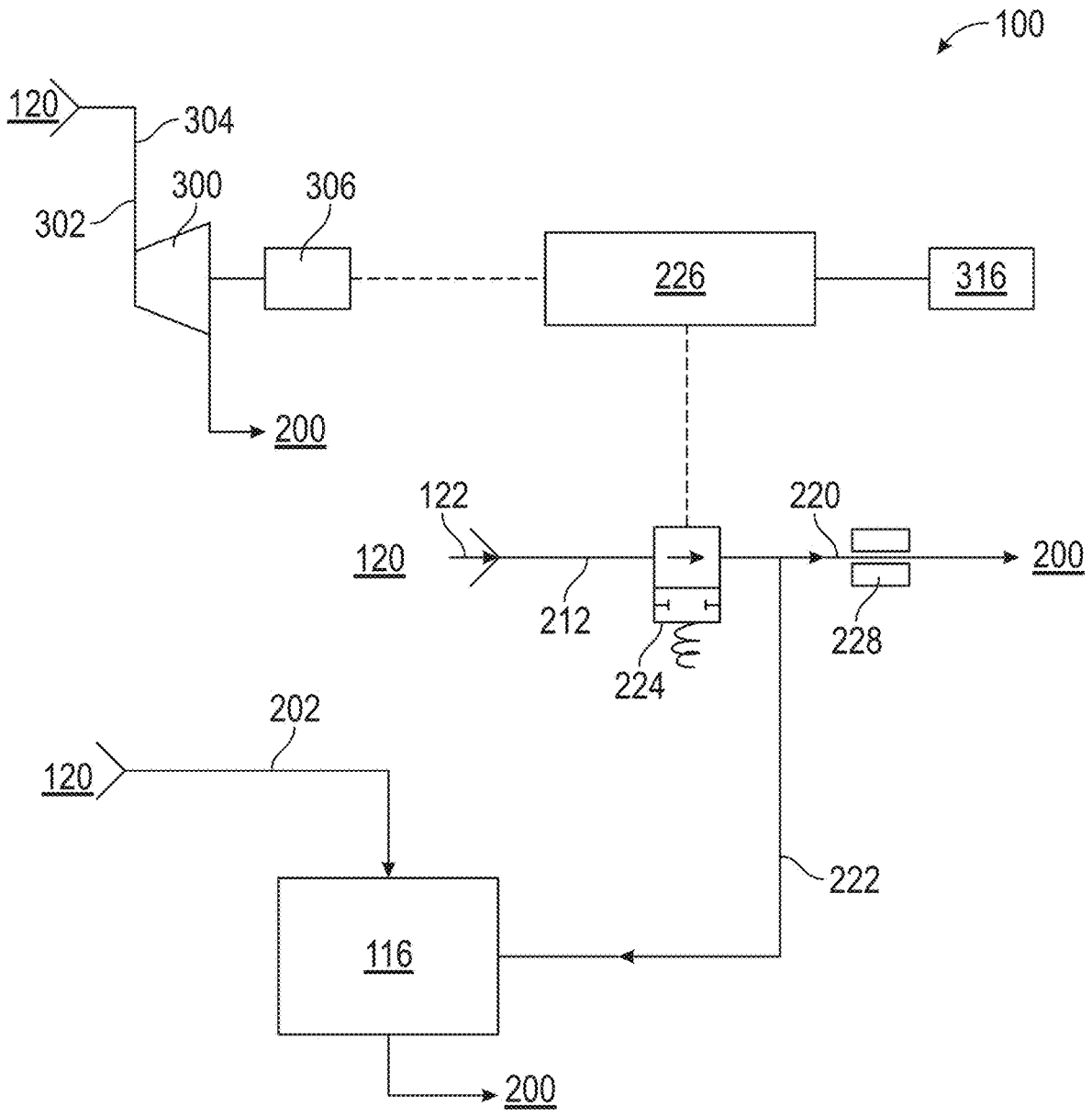
FIG. 5 illustrates a schematic view of a fluidic manifold, in accordance with one or more embodiments of the present disclosure.

FIG. 5 illustrates a schematic view of the fluidic manifold, in accordance with one or more embodiments of the present disclosure. As illustrated, the downhole system 100 includes the turbine 300 disposed along the flow path 302 (e.g., a power fluid line 304) extending from the annulus 120 to the central bore 200 of the downhole tubular 112 (shown in FIG. 3). The turbine 300 is configured to rotate in response to formation fluid in the flow path 302 flowing through the turbine 300. A s set forth above, the generator 306 is coupled to the turbine 300. As the turbine 300 rotates, the generator 306 may generate power for the system controller 226, the solenoid valve 224, and/or other electronic devices. The system controller 226 is configured to output instructions to the solenoid valve 224.

The solenoid valve 224 may be in electronic communication with the system controller 226 such that solenoid valve 224 may be configured to actuate between an open and closed state in response to instructions from the system controller 226. Further, the solenoid valve 224 may be configured to actuate to at least one partially open state. For example, the solenoid valve 224 may be configured to actuate between a closed state, a 33% open state, a 66% open state, and an open state. Alternatively, the solenoid valve 224 may be configured to actuate between any suitable combination of states.

The solenoid valve 224 may be positioned in the pilot line 212 between the annulus 120 and the production valve 116. As such, the formation fluid 122 may be configured to flow from the annulus 120, through the solenoid valve 224 and to the production valve 116 with the solenoid valve 224 in an open state. Further, as illustrated, the solenoid valve 224 may also be positioned in the pilot line 212 between the annulus 120 and a flow restrictor 228 (e.g., the pilot line choke nozzle, the elongated section, etc.). The formation fluid 122 may be configured to pass through the flow restrictor 228 to the central bore 200 of the downhole tubular 112. However, the flow restrictor 228 is configured to add flow resistance to the fluid passing through the flow restrictor 228 such that the pressure in the pilot line 212 (i.e., between the solenoid valve 224, the production valve 116, and the flow restrictor 228) may increase. The amount of pressure in the pilot line 212 may be based at least in part on the flow rate of formation fluid through the solenoid valve 224, as well as the effectiveness of the flow restrictor 228. Moreover, actuating the solenoid valve between various states (e.g., open, partially open, closed, etc.) may control the pressure in the pilot line.

Further, as set forth above, the downhole tubular 112 may include the at least one production valve 116 configured to control flow of formation fluid 122 into the inner diameter (e.g., central bore 200) of the downhole tubular 112 from the annulus 120 of the wellbore (shown in FIG. 2). As set forth above, the production valve 116 may be disposed in the production fluid line 202 from the annulus 120 to the central bore 200 of the downhole tubular 112. As illustrated, the production fluid line 202 and the power fluid line 304 may be separate fluid paths. Alternatively, as set forth in greater detail below, the production fluid line 202 and the power fluid line 304 may be the same path such that the turbine 300 and the production valve 116 may be disposed in the same flow path. Moreover, the production valve 116 is configured to restrict flow of the formation fluid 122 into the central bore 200 of the downhole tubular 112, via the production fluid line 202, based on a state (e.g., open, partially open, closed, etc.) of the production valve 116. As set forth above, the state of the production valve 116 may be based at least in part on the pressure in the pilot line 212.

For example, the system controller 226 may determine that the formation fluid 122 entering into the downhole tubular 112 via the production valve has a high percentage of water based on sensor data from the sensor 316. As such, it may be desirable to restrict or reduce flow of the formation fluid 122 into the downhole tubular 112 via the production valve 116. Accordingly, the system controller 226, powered by the turbine 300 and generator 306, may output a signal to the solenoid valve 224 to open. Opening the solenoid valve 224 may result in an increased pressure drop in the pilot line 212 (e.g., the main pilot line 214, the first pilot line branch 220, and the second pilot line branch 222), closing the production valve 116. Moreover, the production valve 116 may be configured to remain in a closed state in response to pressure from the pilot line 212 holding the production valve 116 closed. Thus, the production valve 116 may be configured to open in response to the pressure reduction in the pilot line 212 from the solenoid valve 224 closing. Further, with the production valve 116 closed, formation fluid into the central bore 200, via the production fluid line 202 and the pilot line 212, may be restricted, which should reduce the flow rate of the formation fluid 122 having a high percentage of water entering the central bore 200 of the downhole tubular 112.

Alternatively, the production valve 116 may be configured to open in response to a pressure increase in the pilot line 212 from the solenoid valve 224 opening. Thus, with the production valve 116 opened, formation fluid 122 into the central bore, via the production fluid line 202, may be less restricted, which should increase the flow rate of the formation fluid 122 having a high percentage of oil entering the central bore 200 of the downhole tubular 112.

Figure 6:
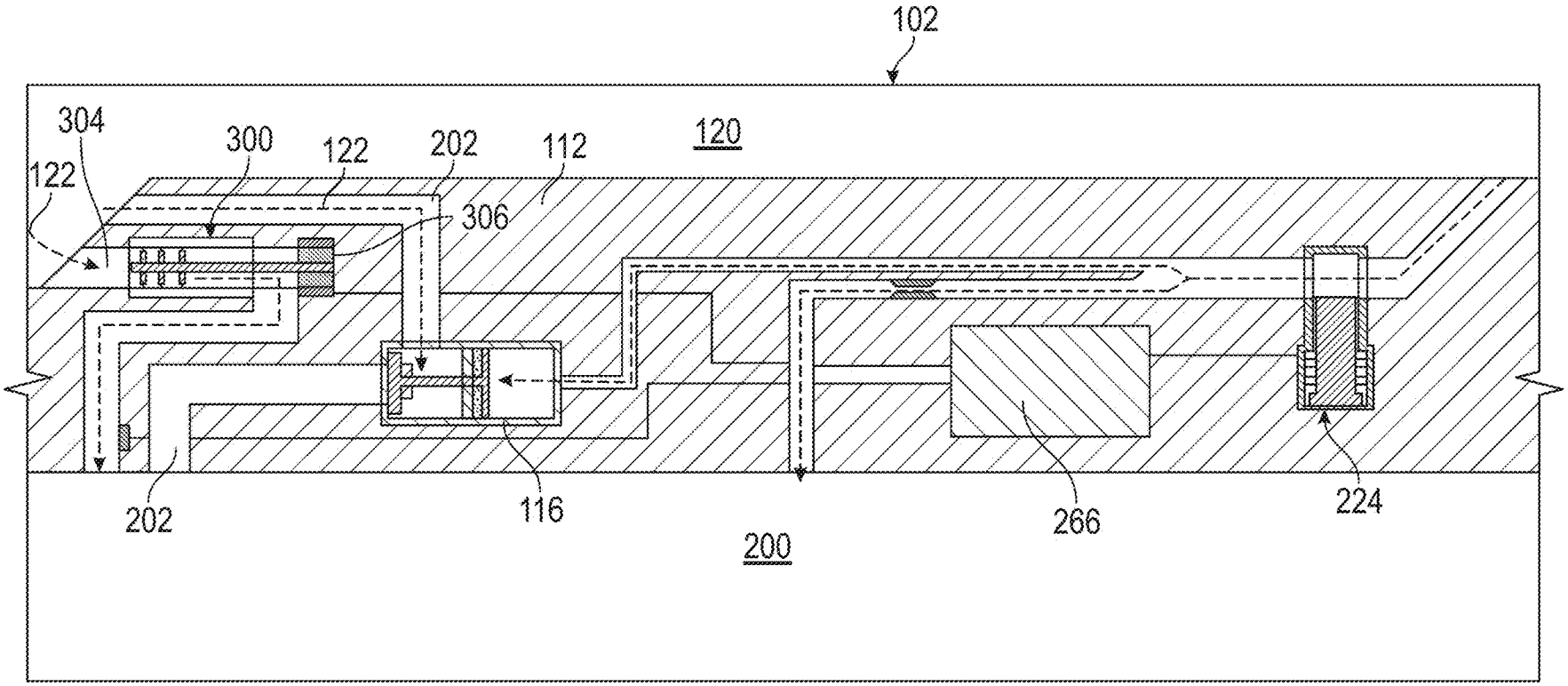
FIG. 6 illustrates a cross-sectional view of the downhole production valve and the power generation assembly, in accordance with one or more embodiments of the present disclosure.

FIG. 6 illustrates a cross-sectional view of the downhole production valve and the power generation assembly, in accordance with one or more embodiments of the present disclosure. As set forth above, the turbine 300 may be secured within the downhole tubular 112 in a position along the power fluid line 304 extending from the annulus 120 of the wellbore 102 to the central bore 200 of the downhole tubular 112 (see FIG. 3). Further, as set forth above the turbine 300 may be configured to rotate in response to the formation fluid 122 flowing along the power fluid line 304 to generate power, via the generator 306, for the system controller 226, the solenoid valve 224, etc. The production valve 116 may be disposed adjacent the turbine 300 and the generator 306. However, as illustrated, the production valve 116 may be disposed in a separate fluid line (e.g., the production fluid line 202) than the turbine 300 and the generator 306, which are disposed in the power fluid line 304, such that the turbine 300 and generator 306 may continue to generate power with the production valve 116 in the closed position.

Figure 7:
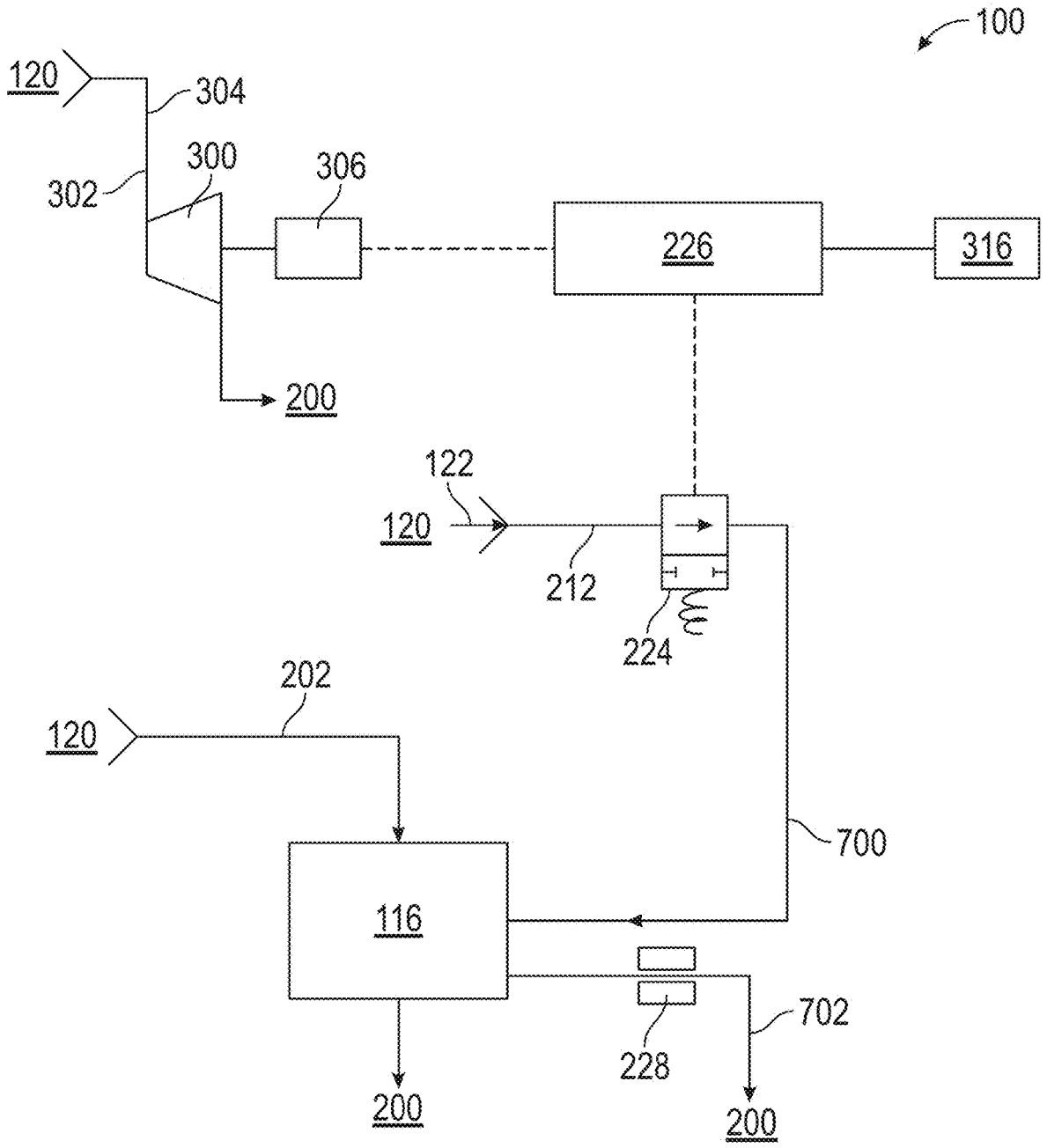
FIG. 7 illustrates a schematic view of a fluidic manifold having a flow restrictor positioned between at least one production valve and a central bore of a downhole tubular, in accordance with one or more embodiments of the present disclosure.

FIG. 7 illustrates a schematic view of a fluidic manifold having a flow restrictor positioned between at least one production valve and a central bore of a downhole tubular, in accordance with one or more embodiments of the present disclosure. As set forth above, the downhole system 100 includes the turbine 300 disposed along the flow path 302 (e.g., a power fluid line 304) extending from the annulus 120 to the central bore 200 of the downhole tubular 112 (shown in FIG. 3). The turbine 300 is configured to rotate in response to formation fluid in the flow path 302 flowing through the turbine 300. As set forth above, the generator 306 is coupled to the turbine 300. As the turbine 300 rotates, the generator 306 may generate power for the system controller 226, the solenoid valve 224, and/or other electronic devices. The system controller 226 is configured to output instructions to the solenoid valve 224.

Further, as set forth above, the solenoid valve 224 may be in electronic communication with the system controller 226 such that solenoid valve 224 may be configured to actuate between an open and closed state in response to instructions from the system controller 226. Further, the solenoid valve 224 may be configured to actuate to at least one partially open state. For example, the solenoid valve 224 may be configured to actuate between a closed state, a 33% open state, a 66% open state, and an open state. Alternatively, the solenoid valve 224 may be configured to actuate between any suitable combination of states.

The solenoid valve 224 may be positioned in the pilot line 212 between the annulus 120 and the production valve 116. In particular, the solenoid valve 224 may be positioned in a first pilot line portion 700 of the pilot line 212. As illustrated, the first pilot line portion 700 may extend into the body portion of the downhole tubular 112 from the annulus 120 to the production valve 116. As such, the formation fluid 122 may be configured to flow from the annulus 120, through the solenoid valve 224 and to the production valve 116 with the solenoid valve 224 in an open state.

Moreover, as illustrated, the pilot line 212 may further include a second pilot line portion 702 extending from the production valve 116 to the central bore 200. The flow restrictor 228 (e.g., the pilot line choke nozzle, the elongated section, etc.) may be disposed within the second pilot line portion 702. The formation fluid 122 flowing through the pilot line 212 is configured to pass through the flow restrictor 228 as the formation fluid 122 flows toward the central bore 200 of the downhole tubular 112. The flow restrictor 228 is configured to add flow resistance to the fluid passing through the flow restrictor 228 such that the pressure in the pilot line 212 may increase. The amount of pressure in the pilot line 212 may be based at least in part on the flow rate of formation fluid through the solenoid valve 224, as well as the effectiveness of the flow restrictor 228. Moreover, actuating the solenoid valve between various states (e.g., open, partially open, closed, etc.) may control the pressure in the pilot line 212.

Further, as set forth above, the downhole tubular 112 may include the at least one production valve 116 configured to control flow of formation fluid 122 into the inner diameter (e.g., central bore 200) of the downhole tubular 112 from the annulus 120 of the wellbore (shown in FIG. 2). As set forth above, the production valve 116 may be disposed in the production fluid line 202 from the annulus 120 to the central bore 200 of the downhole tubular 112. The production valve 116 is configured to restrict flow of the formation fluid 122 into the central bore 200 of the downhole tubular 112, via the production fluid line 202, based on a state (e.g., open, partially open, closed, etc.) of the production valve 116. As set forth above, the state of the production valve 116 may be based at least in part on the pressure in the pilot line 212.

For example, the system controller 226 may determine that the formation fluid 122 entering into the downhole tubular 112 via the production valve has a high percentage of water based on sensor data from the sensor 316. As such, it may be desirable to restrict or reduce flow of the formation fluid 122 into the downhole tubular 112 via the production valve 116. Accordingly, the system controller 226, powered by the turbine 300 and generator 306, may output a signal to the solenoid valve 224 to open. Opening the solenoid valve 224 may increase pressure in the pilot line 212. Further, increasing the pressure in the pilot line 212 above a threshold actuation pressure may be configured to close the production valve 116. Moreover, the production valve 116 may be configured to remain in a closed state in response to pressure from the pilot line 212 holding the production valve 116 closed. Thus, the production valve 116 may be configured to open in response to the pressure reduction in the pilot line 212 from the solenoid valve 224 closing.

Accordingly, the present disclosure may provide a system and method for opening and closing a production valve via a fluidic manifold. The system and method may include any of the various features disclosed herein, including one or more of the following statements.

Statement 1. A system, comprising: a production valve secured within a downhole tubular in a production fluid line extending through a body portion of the downhole tubular between an annulus of a wellbore and a central bore of the downhole tubular, wherein the production valve is configured to actuate between an open state and a closed state to control flow of a formation fluid through the production fluid line; a pilot line extending into the body portion of the downhole tubular from the annulus to at least the production valve; a flow restrictor disposed within the pilot line, wherein the flow restrictor is configured to restrict flow through the pilot line to increase fluid pressure in the pilot line; and a solenoid valve secured within the pilot line, wherein the solenoid valve is configured to actuate between an open state and a closed state in response to instructions from a controller, wherein a pressure in the pilot line is configured to rise above an actuation threshold pressure configured to close the production valve in response to formation fluid flowing through the solenoid valve in the open state of the solenoid valve.

Statement 2. The system of statement 1, wherein the pressure in the pilot line is configured to fall below the actuation threshold pressure configured to open the production valve in response to the solenoid valve restricting flow into the pilot line in the closed state of the solenoid valve.

Statement 3. The system of statement 1 or statement 2, further comprising a turbine secured within the downhole tubular in a position along a power fluid line extending from the annulus of the wellbore to the central bore of the downhole tubular, wherein the turbine is configured to rotate in response to the formation fluid flowing along the power fluid line.

Statement 4. The system of any preceding statement, further comprising a turbine secured within the downhole tubular along the production fluid line in a position between the annulus of the wellbore and the production valve, wherein the turbine is configured to rotate in response to the formation fluid flowing along a power fluid line.

Statement 5. The system of any preceding statement, further comprising a generator secured to the downhole tubular, wherein the generator is coupled to a turbine configured to rotate in response to flow of the formation fluid through the turbine, and wherein the generator is configured to generate power for the controller and/or the solenoid valve in response to rotation of the turbine.

Statement 6. The system of any preceding statement, further comprising the controller and at least one sensor configured to measure at least one parameter of the formation fluid flowing into the central bore, wherein the at least one sensor is configured to output sensor data to the controller, and wherein the sensor data includes the at least one measured parameter.

Statement 7. The system of any preceding statement, wherein the controller is configured to determine a percentage of water in the formation fluid based at least in part on the sensor data received from the at least one sensor, and wherein the controller is configured to output instructions to the solenoid valve to actuate to the open state in response to determining that the percentage of water in the formation fluid is greater than 60%.

Statement 8. The system of any preceding statement, wherein the flow restrictor includes a pilot line choke nozzle disposed within the pilot line.

Statement 9. The system of any preceding statement, wherein the flow restrictor includes a tortuous fluid path formed along the pilot line, wherein the tortuous fluid path is configured to increase flow resistance through at least a portion of the pilot line to increase fluid pressure in the pilot line.

Statement 10. The system of any preceding statement, wherein the pilot line includes a pilot line having a main pilot line portion extending into the body portion of the downhole tubular from the annulus to a pilot line junction, a first pilot line branch extending from the pilot line junction to the central bore, and a second pilot line branch extending from the pilot line junction to the production valve, and wherein the solenoid valve is secured within the main pilot line portion of the pilot line.

Statement 11. The system of any preceding statement, wherein the flow restrictor is disposed within the first pilot line branch, and wherein the flow restrictor is configured to restrict flow through the first pilot line branch to increase fluid pressure in the pilot line between the production valve and the flow restrictor.

Statement 12. The system of any preceding statement, wherein the flow restrictor includes a tortuous fluid path formed along the first pilot line branch, wherein the tortuous fluid path is configured to increase flow resistance through at least a portion of the first pilot line branch to increase fluid pressure in the pilot line, wherein the tortuous fluid path includes an elongated section of the first pilot line branch, wherein the elongated section of the first pilot line branch includes an elongated length and an inner diameter, and wherein the elongated length is at least fifty times longer than the inner diameter.

Statement 13. The system of any preceding statement, wherein the production fluid line includes an upper production line portion extending from the annulus of the wellbore to the production valve, wherein the upper production line portion includes a larger diameter than the pilot line.

Statement 14. The system of any preceding statement, wherein the solenoid valve includes a pilot-operated solenoid valve.

Statement 15. The system of any of statements 1-13, wherein the solenoid valve includes a direct-acting solenoid valve.

Statement 16. The system of any preceding statement, wherein the solenoid valve is configured to actuate to a partially open state in response to instructions received from the controller, wherein the pressure in the pilot line is configured be within a partial activation pressure range with the solenoid valve in the partially open state, and wherein the production valve is configured to actuate to a partially open state in response to pressure in the pilot line being within the partial activation pressure range.

Statement 17. The system of any preceding statement, wherein the production valve includes a diaphragm type valve, a bellows type valve, a pilot operated valve, a piston valve, or some combination thereof.

Statement 18. The system of any of statements 1-9 and 13-17, wherein the pilot line includes a first pilot line portion and second pilot line portion, wherein the first pilot line portion extends into the body portion of the downhole tubular from the annulus to the production valve, wherein the solenoid valve is secured within the first pilot line portion, wherein the second pilot line portion extends from the production valve to the central bore, and wherein the flow restrictor is disposed within the second pilot line portion.

Statement 19. A system, comprising: a production valve secured within a downhole tubular in a production fluid line extending through a body portion of the downhole tubular between an annulus of a wellbore and a central bore of the downhole tubular, wherein the production valve is configured to actuate between an open state and a closed state to restrict flow of a formation fluid through the production fluid line; a pilot line having a main pilot line portion extending into the body portion of the downhole tubular from the annulus to a pilot line junction, a first pilot line branch extending from the pilot line junction to the central bore, and a second pilot line branch extending from the pilot line junction to the production valve; a flow restrictor disposed within the first pilot line branch, wherein the flow restrictor is configured to restrict flow through the first pilot line branch to increase fluid pressure in the pilot line between the production valve and the flow restrictor; a sensor configured to measure at least one parameter of the formation fluid flowing into the central bore via the production fluid line, wherein the sensor is configured to output sensor data, and wherein the sensor data includes the at least one measured parameter; a controller configured to receive the sensor data, wherein the controller is configured to determine a percentage of water in the formation fluid based at least in part on the sensor data received from the sensor, and wherein the controller is configured to output actuation instructions in response to determining that the percentage of water in the formation fluid is greater than a predetermined threshold; and a solenoid valve secured within the main pilot line portion of the pilot line, wherein the solenoid valve is configured to actuate between an open state and a closed state in response to actuation instructions from the controller, wherein a pressure in the pilot line is configured to rise above an actuation threshold pressure configured to close the production valve in response to the formation fluid flowing through the solenoid valve in the open state of the solenoid valve, and wherein the pressure in the pilot line is configured to fall below the actuation threshold pressure configured to open the production valve in response to the solenoid valve restricting flow into the pilot line in the closed state.

Statement 20. A method, comprising: providing power to a controller via a generator driven by a turbine disposed in a flow path from an annulus of wellbore to a central bore of a downhole tubular; and outputting instructions from the controller to a solenoid valve to actuate the solenoid valve between an open state and a closed state, wherein the solenoid valve is disposed in a pilot line extending between the annulus of the wellbore and a production valve, wherein the pressure in the pilot line is above a threshold pressure for holding the production valve closed with the solenoid valve disposed in the open state, and wherein the pressure in the pilot line is below the threshold pressure for holding the production valve closed with the solenoid valve disposed in the closed state.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A system, comprising:

a production valve secured within a downhole tubular in a production fluid line extending through a body portion of the downhole tubular between an annulus of a wellbore and a central bore of the downhole tubular, wherein the production valve is configured to actuate between an open state and a closed state to control flow of a formation fluid through the production fluid line;

a pilot line extending into the body portion of the downhole tubular from the annulus to at least the production valve;

a flow restrictor disposed within the pilot line, wherein the flow restrictor is configured to restrict flow through the pilot line to increase fluid pressure in the pilot line; and a solenoid valve secured within the pilot line, wherein the solenoid valve is configured to actuate between an open state and a closed state in response to instructions from a controller, wherein a pressure in the pilot line is configured to rise above an actuation threshold pressure configured to close the production valve in response to formation fluid flowing through the solenoid valve in the open state of the solenoid valve.

2. The system of claim 1, wherein the pressure in the pilot line is configured to fall below the actuation threshold pressure configured to open the production valve in response to the solenoid valve restricting flow into the pilot line in the closed state of the solenoid valve.

3. The system of claim 1, further comprising a turbine secured within the downhole tubular in a position along a power fluid line extending from the annulus of the wellbore to the central bore of the downhole tubular, wherein the turbine is configured to rotate in response to the formation fluid flowing along the power fluid line.

4. The system of claim 1, further comprising a turbine secured within the downhole tubular along the production fluid line in a position between the annulus of the wellbore and the production valve, wherein the turbine is configured to rotate in response to the formation fluid flowing along a power fluid line.

5. The system of claim 1, further comprising a generator secured to the downhole tubular, wherein the generator is coupled to a turbine configured to rotate in response to flow of the formation fluid through the turbine, and wherein the generator is configured to generate power for the controller and/or the solenoid valve in response to rotation of the turbine.

6. The system of claim 1, further comprising the controller and at least one sensor configured to measure at least one parameter of the formation fluid flowing into the central bore, wherein the at least one sensor is configured to output sensor data to the controller, and wherein the sensor data includes the at least one measured parameter.

7. The system of claim 6, wherein the controller is configured to determine a percentage of water in the formation fluid based at least in part on the sensor data received from the at least one sensor, and wherein the controller is configured to output instructions to the solenoid valve to actuate to the open state in response to determining that the percentage of water in the formation fluid is greater than 60%.

8. The system of claim 1, wherein the flow restrictor includes a pilot line choke nozzle disposed within the pilot line.

9. The system of claim 1, wherein the flow restrictor includes a tortuous fluid path formed along the pilot line, wherein the tortuous fluid path is configured to increase flow resistance through at least a portion of the pilot line to increase fluid pressure in the pilot line.

10. The system of claim 1, wherein the pilot line includes a main pilot line portion extending into the body portion of the downhole tubular from the annulus to a pilot line junction, a first pilot line branch extending from the pilot line junction to the central bore, and a second pilot line branch extending from the pilot line junction to the production valve, and wherein the solenoid valve is secured within the main pilot line portion of the pilot line.

11. The system of claim 10, wherein the flow restrictor is disposed within the first pilot line branch, and wherein the flow restrictor is configured to restrict flow through the first pilot line branch to increase fluid pressure in the pilot line between the production valve and the flow restrictor.

12. The system of claim 11, wherein the flow restrictor includes a tortuous fluid path formed along the first pilot line branch, wherein the tortuous fluid path is configured to increase flow resistance through at least a portion of the first pilot line branch to increase fluid pressure in the pilot line, wherein the tortuous fluid path includes an elongated section of the first pilot line branch, wherein the elongated section of the first pilot line branch includes an elongated length and an inner diameter, and wherein the elongated length is at least fifty times longer than the inner diameter.

13. The system of claim 1, wherein the production fluid line includes an upper production line portion extending from the annulus of the wellbore to the production valve, wherein the upper production line portion includes a larger diameter than the pilot line.

14. The system of claim 1, wherein the solenoid valve includes a pilot-operated solenoid valve.

15. The system of claim 1, wherein the solenoid valve includes a direct-acting solenoid valve.

16. The system of claim 1, wherein the solenoid valve is configured to actuate to a partially open state in response to instructions received from the controller, wherein the pressure in the pilot line is configured be within a partial activation pressure range with the solenoid valve in the partially open state, and wherein the production valve is configured to actuate to a partially open state in response to pressure in the pilot line being within the partial activation pressure range.

17. The system of claim 1, wherein the production valve includes a diaphragm type valve, a bellows type valve, a pilot operated valve, a piston valve, or some combination thereof.

18. The system of claim 1, wherein the pilot line includes a first pilot line portion and second pilot line portion, wherein the first pilot line portion extends into the body portion of the downhole tubular from the annulus to the production valve, wherein the solenoid valve is secured within the first pilot line portion, wherein the second pilot line portion extends from the production valve to the central bore, and wherein the flow restrictor is disposed within the second pilot line portion.

19. A system, comprising:

a production valve secured within a downhole tubular in a production fluid line extending through a body portion of the downhole tubular between an annulus of a wellbore and a central bore of the downhole tubular, wherein the production valve is configured to actuate between an open state and a closed state to restrict flow of a formation fluid through the production fluid line;

a pilot line having a main pilot line portion extending into the body portion of the downhole tubular from the annulus to a pilot line junction, a first pilot line branch extending from the pilot line junction to the central bore, and a second pilot line branch extending from the pilot line junction to the production valve;

a flow restrictor disposed within the first pilot line branch, wherein the flow restrictor is configured to restrict flow through the first pilot line branch to increase fluid pressure in the pilot line between the production valve and the flow restrictor;

a sensor configured to measure at least one parameter of the formation fluid flowing into the central bore via the production fluid line, wherein the sensor is configured to output sensor data, and wherein the sensor data includes the at least one measured parameter;

a controller configured to receive the sensor data, wherein the controller is configured to determine a percentage of water in the formation fluid based at least in part on the sensor data received from the sensor, and wherein the controller is configured to output actuation instructions in response to determining that the percentage of water in the formation fluid is greater than a predetermined threshold; and a solenoid valve secured within the main pilot line portion of the pilot line, wherein the solenoid valve is configured to actuate between an open state and a closed state in response to actuation instructions from the controller, wherein a pressure in the pilot line is configured to rise above an actuation threshold pressure configured to close the production valve in response to the formation fluid flowing through the solenoid valve in the open state of the solenoid valve, and wherein the pressure in the pilot line is configured to fall below the actuation threshold pressure configured to open the production valve in response to the solenoid valve restricting flow into the pilot line in the closed state.

20. A method, comprising:

providing power to a controller via a generator driven by a turbine disposed in a flow path from an annulus of wellbore to a central bore of a downhole tubular; and outputting instructions from the controller to a solenoid valve to actuate the solenoid valve between an open state and a closed state, wherein the solenoid valve is disposed within a pilot line extending into a body portion of the downhole tubular from the annulus of the wellbore to at least a production valve, wherein the production valve secured within the downhole tubular in a production fluid line extending through the body portion of the downhole tubular between the annulus of the wellbore and the central bore of the downhole tubular, wherein the production valve is configured to actuate between an open state and a closed state to control flow of a formation fluid through the production fluid line, wherein a flow restrictor is disposed within the pilot line, wherein the flow restrictor is configured to restrict flow through the pilot line to increase fluid pressure in the pilot line, wherein the pressure in the pilot line is configured to rise above an actuation threshold pressure for holding the production valve closed in response to formation fluid flowing through the solenoid valve in the open state of the solenoid valve, and wherein the pressure in the pilot line is configured to fall below the actuation threshold pressure for holding the production valve closed with the solenoid valve disposed in the closed state.

* * * * *